US005520008A

United States Patent [19]

Ophir et al.

[11] Patent Number: 5,520,008

[45] Date of Patent: May 28, 1996

[54] CENTRIFUGAL COMPRESSOR AND HEAT PUMP COMPRISING

[75] Inventors: Avraham Ophir, Herzliya; David Olomutzki, Kfar-Saba; Abraham Koren, Holon; Arie Kanevski, Kfar-Saba, all of Israel

[73] Assignee: I.D.E. Technologies Ltd., Ra'anana, Israel

[21] Appl. No.: 296,572

[22] Filed: Aug. 26, 1994

[30] Foreign Application Priority Data

Sep. 8, 1993 [IL] Israel ..... 106945

[51] Int. Cl.[6] ..... F04D 17/10; F25B 19/00

[52] U.S. Cl. ..... 62/268; 416/185; 416/188; 416/230; 62/510; 62/324.6

[58] Field of Search ..... 416/185, 188, 416/230, 186 R; 62/268, 100, 118, 467, 306, 510, 324.6

[56] References Cited

U.S. PATENT DOCUMENTS

| | | | |
|---|---|---|---|
| 318,884 | 5/1885 | Dwight | 416/188 |
| 605,888 | 6/1898 | Maginot | 416/186 R |
| 2,130,549 | 9/1938 | Kirgan | 62/100 |
| 2,746,269 | 5/1956 | Moody | 62/510 |
| 3,011,322 | 12/1961 | Tanzberger et al. | 62/510 |
| 3,610,590 | 10/1971 | Kaelin | 416/185 |
| 3,953,146 | 4/1976 | Sowards | 416/188 X |
| 4,003,213 | 1/1977 | Cox | 62/124 |
| 4,437,322 | 3/1984 | Ertinger | 62/504 |
| 4,648,794 | 3/1987 | Hunjan et al. | 416/186 R |
| 5,002,461 | 3/1991 | Young et al. | 416/183 |
| 5,317,882 | 6/1994 | Ritenour | 62/268 |

FOREIGN PATENT DOCUMENTS

| | | | |
|---|---|---|---|
| 693727 | 7/1953 | United Kingdom | 416/188 |

*Primary Examiner*—Henry A. Bennett
*Assistant Examiner*—William C. Doerrler
*Attorney, Agent, or Firm*—William C. Gerstenzang; Sprung Horn Kramer & Woods

[57] ABSTRACT

A lightweight, heavy duty, large volume centrifugal compressor for use in mechanical vapor compression systems, especially water vapor compression systems in heat pump installations, said compressor comprising a shaft driven propeller-like rotary member consisting of a frusto-conical hub and a plurality of curved blades made of a lightweight material, each being secured to said hub along a longitudinal curved line and radially extending therefrom; each pair of adjacent blades being interconnected by a bridging membrane member of a lightweight material curvingly extending from the roots of the leading edges of said adjacent blades to the tips of the rear edges of the blades; said rotary member being encompassed within a closely fitting shroud, so that curved vapor flow channels are defined between each said pair of blades, their associated membrane member, and the shroud. There is also provided a mechanical water vapor compression heat pump system comprising a pair of centrifugal compressors according to the invention operating in series.

8 Claims, 6 Drawing Sheets

Fig. 2a
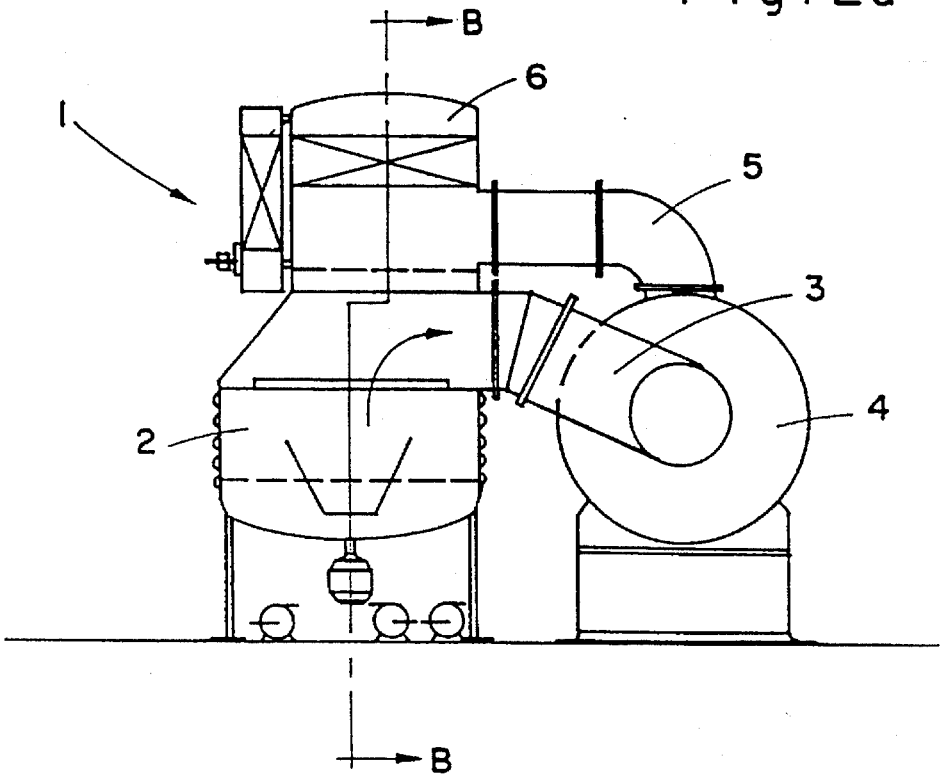
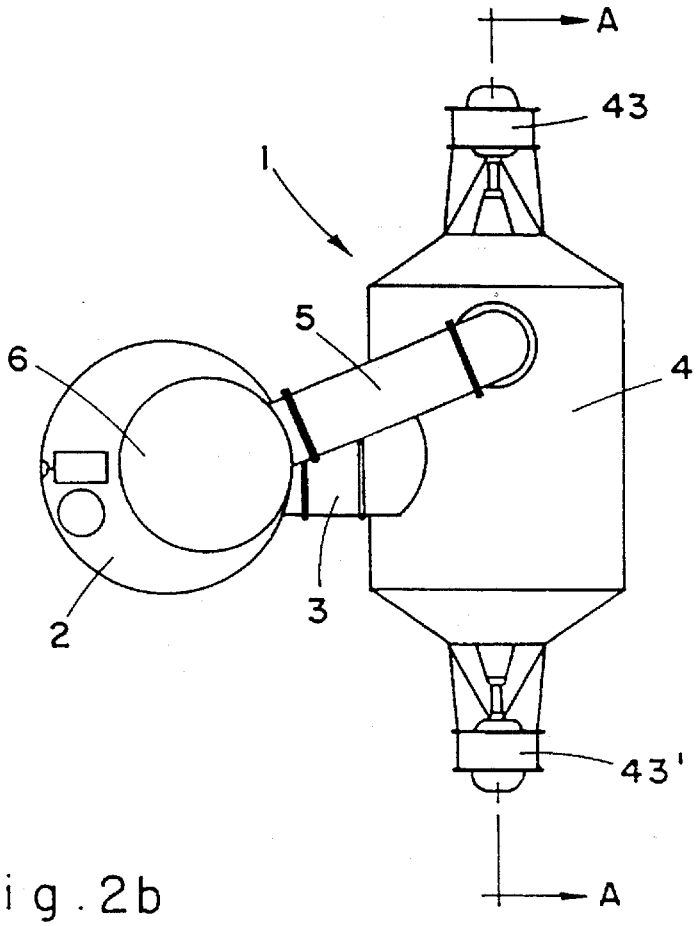
Fig. 2b

CENTRIFUGAL COMPRESSOR AND HEAT PUMP COMPRISING

FIELD OF THE INVENTION

This invention is concerned with a large scale, high performance heat pump installation operating on the principle of mechanical water vapor compression. The invention also provides, for use in the aforementioned heat pump installation, a novel, large volume centrifugal compressor distinguished from and superior to conventional compressors by virtue of its novel structural features and its capacity to attain hitherto unachievable compression ratios and vapor flow rates.

BACKGROUND OF THE INVENTION

Most conventional heat pumps, whether used for heating or cooling purposes, utilize a refrigerant having suitable thermodynamic properties such as ammonia or certain organic fluids, mainly freons. Basically such heat pumps consist of a closed system comprising an evaporator, a compressor, a condensor, if necessary an expansion valve, and various controls. The working fluid (refrigerant) evaporates in the evaporator at a low temperature and pressure, extracting from the surroundings a quantity of heat equal to its heat of vaporization. The refrigerant vapors are compressed by the compressor to a pressure and temperature sufficiently high to enable the refrigerant to condense in the condenser by giving up its heat or vaporization to a stream of cooling water or to the atmosphere.

Heat pumps using water as the refrigerant have also been proposed (see for example U.S. Pat. No. 4,003,213 and Israel Patent 64871) and such systems include ejectors, absorption systems and mechanical vapor compression (MVC) systems. The use of water as a refrigerant is thermodynamically desirable owing to its good thermophysical properties and the advantages of employing direct contact heat transfer, eliminating the need for costly and thermodynamically inefficient heat exchangers. Furthermore, water is the most "environmentally friendly" working fluid available, in contrast with currently used organic working fluids (CFCs) which are environmentally damaging and are likely to be restricted or banned altogether in the coming decade.

Known heat pumps employing water as a working fluid of the ejector and absorption system types are characterized by low efficiency, whereas MVC systems have a much higher efficiency, typically about 2 to 3 times greater. However, a major difficulty involved in the use of water as a refrigerant in MVC systems is the very high specific volume of water vapor which requires the use of a very large compressor. Thus, in a large size refrigeration heat pump having a cooling capacity of about 3 to 10 MW, the required flow rate of water vapor would be about 300–400 $m^3$/sec which is considered a relatively high volumetric flow rate. In addition, for a 20°–30° C. temperature difference (between the space to be cooled and the ambient temperature of the air or cooling water) a compression ratio (CR) of the order of 1:9 would be required.

For this range of flowrates and compression ratios, two basic compressor types are suitable, namely axial and centrifugal. The axial type, as used mainly on aircraft engines is well developed and has a high efficiency but is expensive to produce, therefore the centrifugal type is the most promising for this application. However, to date no centrifugal compressors have been developed which come even close to fulfilling the target specification (i.e. 300–400 $m^3$/sec., 1:9 CR) mentioned above. Compression ratio is a function of tip speed. Typical tip speeds found on small aluminum compressors are of the order of 500 m/sec which gives a CR of approximately 1:3.

Conventional large diameter compressors, which in general do not go beyond 1.6–1.7 m impeller diameter are mainly made of fabricated steel construction (Aluminum alloy casting or machining from solid as used on smaller machines, is not practical in the larger sizes due to difficulties in cooling massive metal sections). Fabricated steel construction generally involves welding individual cast steel blades onto a solid cone (e.g. see Allis Chalmers, Catalogue, 1980, page 337). Such designs are not capable of sustaining the mechanical loads found at say 500 m/sec tip speed due to stress limitations on welded sections. Hence the tip speeds attained by such designs are generally quite low, resulting in compression ratios not more than approximately 1:1.6. This severely restricts the range of process applications. In addition, the sheer weight of the rotor resulting from such construction methods entails a complicated and expensive rotor support system.

Thus, to summarize, conventional large centrifugal compressors exhibit limited CR and volumetric capacity and are costly to manufacture.

OBJECT OF THE INVENTION

It is the object of the present invention to provide an economically feasible large scale heat pump installation operating on the principle of mechanical water vapor compression.

It is a further object of the invention to provide a large volume centrifugal compressor for use in a water vapor compression heat pump installation, having high compression ratios of about 1:3 at tip speeds of about 500 m/sec.

SUMMARY OF THE INVENTION

In accordance with one aspect of the invention there is provided a mechanical water vapor compression heat pump system of the type comprising an evaporator-freezer chamber, a compressor chamber juxtaposed to said evaporator-freezer chamber and a condenser chamber juxtaposed to said compressor chamber;

means for feeding water or an aqueous solution into said evaporator-freezer chamber;

compressor means in said compressor chamber for reducing the pressure in said evaporator-freezer chamber down to the water triple point pressure to cause a portion of said water or aqueous solution to vaporize and another portion to freeze;

said compressor means being further adapted to withdraw the vapor produced within said evaporator-freezer chamber, transport it into the compressor chamber, compressing it therein and transporting the compressed vapor to said condenser chamber;

water spray means in said condenser chamber for cooling and condensing said compressed vapor by direct heat exchange therewith;

means to remove the condensate water together with the cooling water from said condenser chamber;

vacuum pump means for evacuating non-condensible gases from said condenser chamber and means for continuously removing ice-water slurry from said evaporator-freezer chamber and circulating it through heat exchanger means in a space to be cooled, located outside said heat pump system; characterized in that:

said compressor means consist of a pair of centrifugal compressors according to the invention (as defined hereinafter) operating in series and located at the opposite ends of the compressor chamber which is designed as a horizontal cylindrical vessel, each of said compressors being designed as a complete sub-assembly with its adjacent end cover of said compressor chamber; and inter-cooling water spray means are provided in said compressor vessel between said two compressors for cooling the vapor compressed by the first stage compressor before it is further compressed in the second stage compressor.

In accordance with another preferred embodiment of the invention, both the evaporator-freezer chamber and the condensor chamber are juxtaposed comparatively closely to said compressor chamber and are connected therewith by wide, comparatively short and curved vapor inlet and outlet ducts, respectively, offering minimal resistance to the flow of vapor from the freezer-evaporator to the compressor chamber and of compressed vapor from the compressor chamber to the condensor chamber. This eliminates the use of complicated ducting and transfer passages thus giving rise to savings in frictional losses and, more importantly, helping to preserve uniform velocity profiles at the compressor inlet sections.

In accordance with yet another, most preferred embodiment of the invention said condensing chamber is placed on top of said evaporator-freezer chamber both forming together an integral unit, the bottom of the condensing chamber serving as the top of the evaporator-freezer chamber and being subjected to only very low pressure differences between both its sides.

In accordance with another aspect of the invention, there is provided a lightweight, large volume centrifugal compressor for use in mechanical vapor compression systems, especially water vapor compression systems in a heat pump installations, said compressor being capable of handling a vapor flow rate of about 300–400 $m^3$/sec, providing a compression ratio of about 1:3 and sustaining mechanical stresses such as occur at tip speeds of about 500 m/see; said compressor comprising a propeller-like rotary member consisting of a frusto-conical hub and a plurality of curved blades made of a lightweight material, each being secured to said hub along a longitudinal curved line and radially extending therefrom; each pair of adjacent blades being interconnected by a bridging membrane member of a lightweight material curvingly extending from the roots of the leading edges (as defined further on) of said adjacent blades to the tips of the rear edges of the blades (as defined hereinbelow);

said rotary member being driven by a shaft passing through the center of a stationary circular back plate bounding said rotary member at the rear;

said rotary member being encompassed within a closely fitting shroud, so that curved vapor flow channels are defined between each said pair of blades, their associated membrane member, and the shroud.

It should be noted that dead spaces are defined in the compressor between the back plate, the hub, the adjacent blades and the membrane members, thus significantly reducing the weight of the rotary member which results in reducing mechanical stresses in the rotary member and enables to achieve a higher tip speed and consequently higher compression ratios.

Said hub is preferably manufactured of aluminum and said blades and said membrane members are preferably manufactured of a composite material thus significantly reducing the weight of the rotary member, which also results in reducing mechanical stresses in the rotary member and enables to achieve higher tip speed and, consequently, higher compression ratio.

Several terms have to be defined at this stage in order to simplify the further description of the rotary member _. The smaller end of the frusto-conical hub _ will be referred to as "forward end"; and the larger end of the hub _ as its "aft end". The edges of the blades _ are termed (see FIG. 4) as follows: A—the blade root; B—the leading edge; C—the contour edge; D—the trailing edge; and E—the rear edge.

In a preferred embodiment of the invention said frusto-conical hub is formed at its aft end with a co-axial frusto-conical recess and is seated on a corresponding frusto-conical stationary support cantilevered from said stationary back plate; said shaft driving the frusto-conical hub passes through an axial bore in said stationary support and rotates therein by the aid of a pair of bearings located in said bore adjacent to its two ends; the center of gravity of said rotary member being between said bearing span.

This embodiment (a) allows further reduction of the weight of the rotary member owing to the recess; (b) shortens the bending arm (moment) on the shaft, thus allowing a reduction in shaft diameter, due to locating both the stationary support and the pair of bearings inside the rotary member.

In a preferred embodiment of the invention each curved blade is shaped so that the radius extending from the axis of the hub to any point on the central line of the contour edge of the blade is full), contained inside the blade. Such a construction practically eliminates bending forces on the blades, allowing the centrifugal forces to pull the blades only in the radial direction. This permits the structural fiber reinforced (composite) material to operate under favorable mechanical conditions, i.e., direct tension. This maximizes the permissible tip speed limit.

In one preferred embodiment of the invention there are provided additional shorter blades (so-called "splitters") extending from the aft end of said hub and terminating between each pair of adjacent regular-length curved blades.

BRIEF DESCRIPTION OF THE DRAWINGS

The invention will now be further described in more detail with the aid of the accompanying non-limiting drawings, in which:

FIG. 2*a* is a schematic cross-sectional view of the heat pump installation of FIG. 1;

FIG. 2*b* is a schematic top view of the heat pump installation of FIG. 1;

DETAILED DESCRIPTION OF THE INVENTION

The heat pump installation

Figure 1:
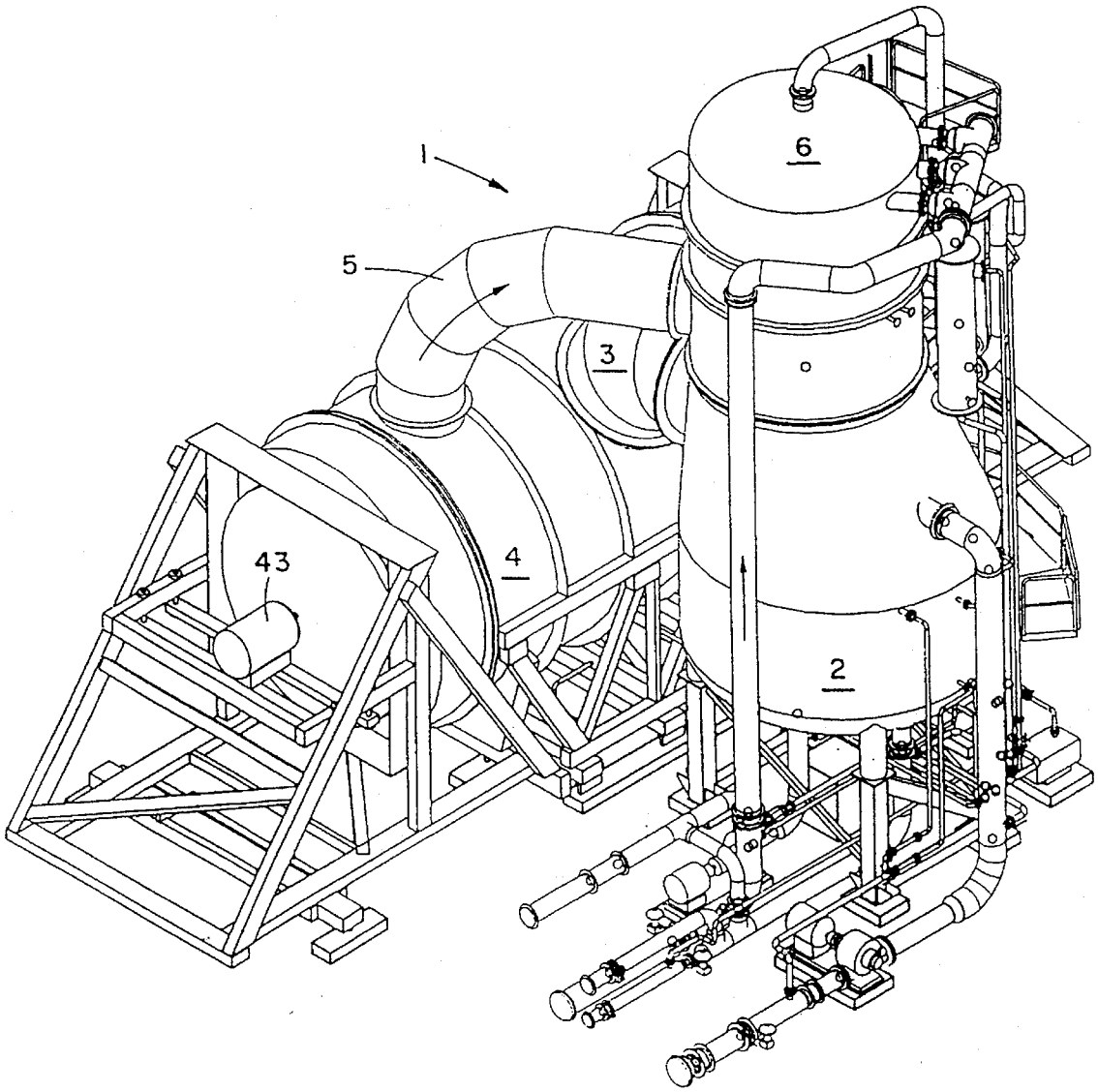
FIG. 1 is a schematic perspective view of a typical heat pump installation according to one embodiment of the invention.

As shown schematically in FIGS. 1, 2*a* and 2*b* a mechanical water vapor compression heat pump installation generally referenced 1, according to one embodiment of the invention, comprises an evaporator-freezer unit (or flash chamber) 2, connected by means of a vapor inlet duct 3 to an adjacent cylindrical compressor vessel 4 which, in turn, is connected by means of a compressed vapor duct 5 to a condenser chamber 6 located above the evaporator-freezer 2 and integral therewith.

The feed water enters the heat pump installation via the evaporator-freezer 2 which is maintained at vacuum conditions by a pair of compressors 7, 7' operating in series and located at opposite ends of the cylindrical compressor vessel 4. The water in the evaporator-freezer 2 is thereby cooled by evaporation to the water triple point (about 0° C. and 4.6 mm/Hg). The evaporator-freezer 2 is provided with an agitator 8 with scoops, driven by an external motor, designed to continuously agitate the ice/water slurry in the evaporator-freezer 2, the surface layer of which is thus constantly renewed, preventing the build-up of a stagnant ice layer and maximizing the coefficient of heat transfer (by direct evaporation). In addition, the scoops of the agitator 8 are designed to continuously wet the walls of the evaporator-freezer chamber 2 in order to prevent the formation of "chunk" ice and to promote the formation of discrete ice crystals. This is important in order to avoid eventual blockage of the exit to the evaporator-freezer 2 by ice formation. Alternatively, or in addition, the formation of ice in small crystal form may also be assisted by adding salt to the feed water.

The vapor produced in the evaporator-freezer 2 passes through the vapor inlet duct 3 into the compressor chamber 4 at 0° C. and is compressed therein by the first stage compressor 7 at a compression ratio of about 1:3. The compressed vapor is directed by the aerodynamic flow channels formed by the compressor shroud 9 (as explained hereinbelow) backwards in the axial direction of the compressor chamber 4 towards the second stage compressor 7' and its associated shroud 9', wherein it is further compressed by the same ratio of approximately 1:3, so that the total compression ratio of the vapor is approximately 1:9. Between the first and second stage compressors 7 and 7' there is interposed a direct water injection de-superheater (or intercooler) 41 which brings the inlet temperature of the vapor into the second stage compressor 7' down to about 15° C. Between the de-superheater 41 and the second stage compressor 7' there is interposed a conventional droplet separator 42. The vapor exiting the second stage compressor 7' has a saturation temperature exceeding ambient temperature or that of available cooling water, thus permitting heat rejection.

Figure 3A:
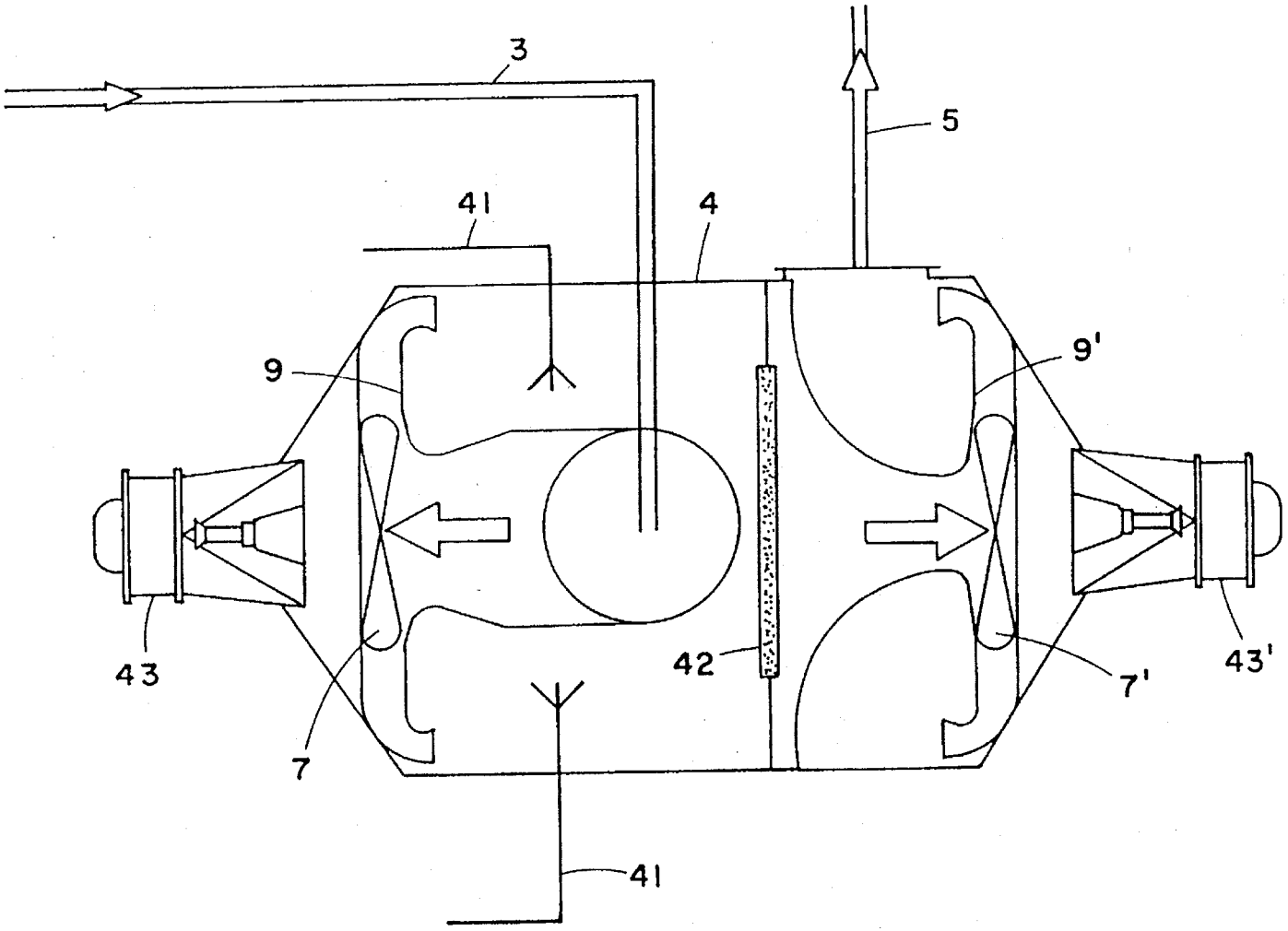
FIG. 3*a* is a schematic axial cross-sectional view of the compressor vessel of the heat pump installation of FIG. 1 taken along line A—A in FIG. 2*b;*
Figure 3B:
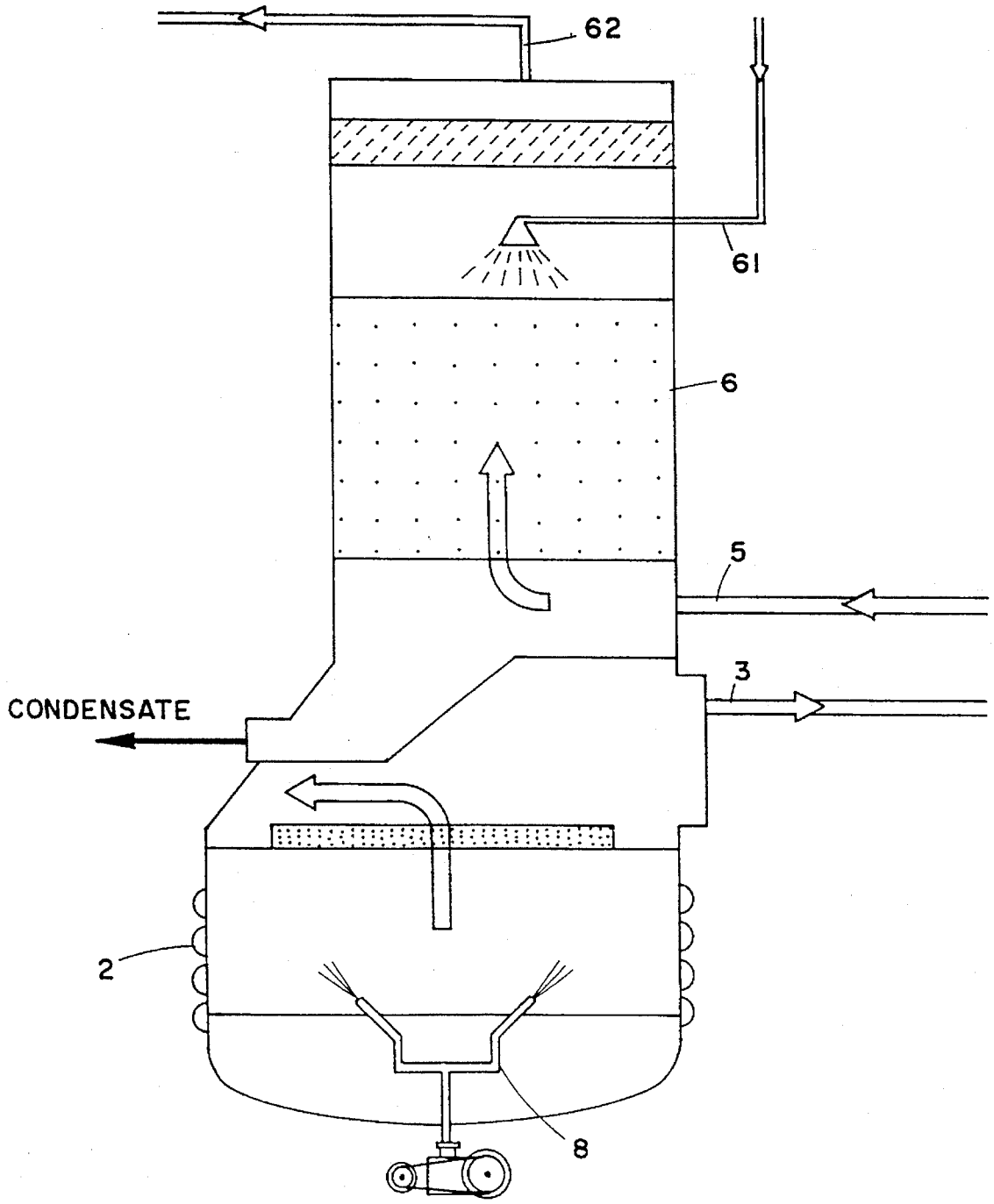
FIG. 3*b* is a schematic cross-sectional view of the evaporator-freezer and the condenser units of the heat pump installation according to FIG. 1 taken along the lines B—B in FIG. 2*a;*

The compressed vapor is passed from the second stage compressor 7' into the condenser unit 6 consisting of a packed bed provided with cooling water spray means 61 at the top, fed by a water circulation pump. The compressed water vapor rises in the condenser 6 through the packed bed here it comes into direct counter-current contact with the downward flowing cooling water. The vapor condenses and the latent heat of condensation absorbed by the cooling water is rejected to the atmosphere via the condensate and cooling water which are removed together from the system. The condenser 6 is continuously purged of non-condensible gases by a vacuum pump via the duct 62 (FIG. 3*b*).

It should be noted that the circulating pump providing the cooling water 2 to the condenser 6 need only supply enough head to overcome frictional losses, since the major part of the head required to lift the cooling water up to the top of the condenser 6 is supplied by the vacuum in the system.

The water/ice slurry produced in the evaporator-freezer 2 can be conveniently pumped out, concentrated if desired and delivered to the end-user, i.e. the space which is to be cooled by the heat pump installation.

It can be seen from the abovementioned figures that the total layout of the installation is very compact, with the two compressors 7, 7' facing each other at either end of the compressor vessel 4. For flexibility of operation, each compressor 7 and 7' is driven independently by an externally mounted, frequency converter controlled electric motor 43, 43'. The diffusers are arranged to turn axially, thus facilitating the flow of vapor from the exit of the first stage via the de-superheater 41 and droplet separator 42 to the intake of the second stage. By placing both compressors within the compressor vessel 4, considerable economies are achieved in that the compressor shrouds 9, 9' can be constructed from very light materials since they do not have to withstand the full force of vacuum (approximately 700–750 mm/Hg) which force is taken up by the pressure vessel walls. The shrouds 9, 9' thus only need to withstand a pressure difference of at most 12 mm/Hg. On the other hand, the compressor vessel 4 itself is designed in the shape of a simple cylinder which is well capable of coping with the full force of vacuum. Furthermore, the incorporation of both compressors 7, 7' in the one compressor vessel 4 saves the cost of transfer piping from the first stage compressor to the second stage compressor, as in previously proposed installations.

The construction of the evaporator-freezer 2 and the condenser 6 is an integral unit having a common partition which serves at the same time as the bottom of the condenser 6 and the top of the evaporator 2, again saving some construction costs since the pressure difference acting on this partition is only about 30–40 mm/Hg instead of 750–755 mm/Hg which would result if the freezer top and the condenser bottom were subjected to atmospheric pressure.

The compressor

Figure 4:
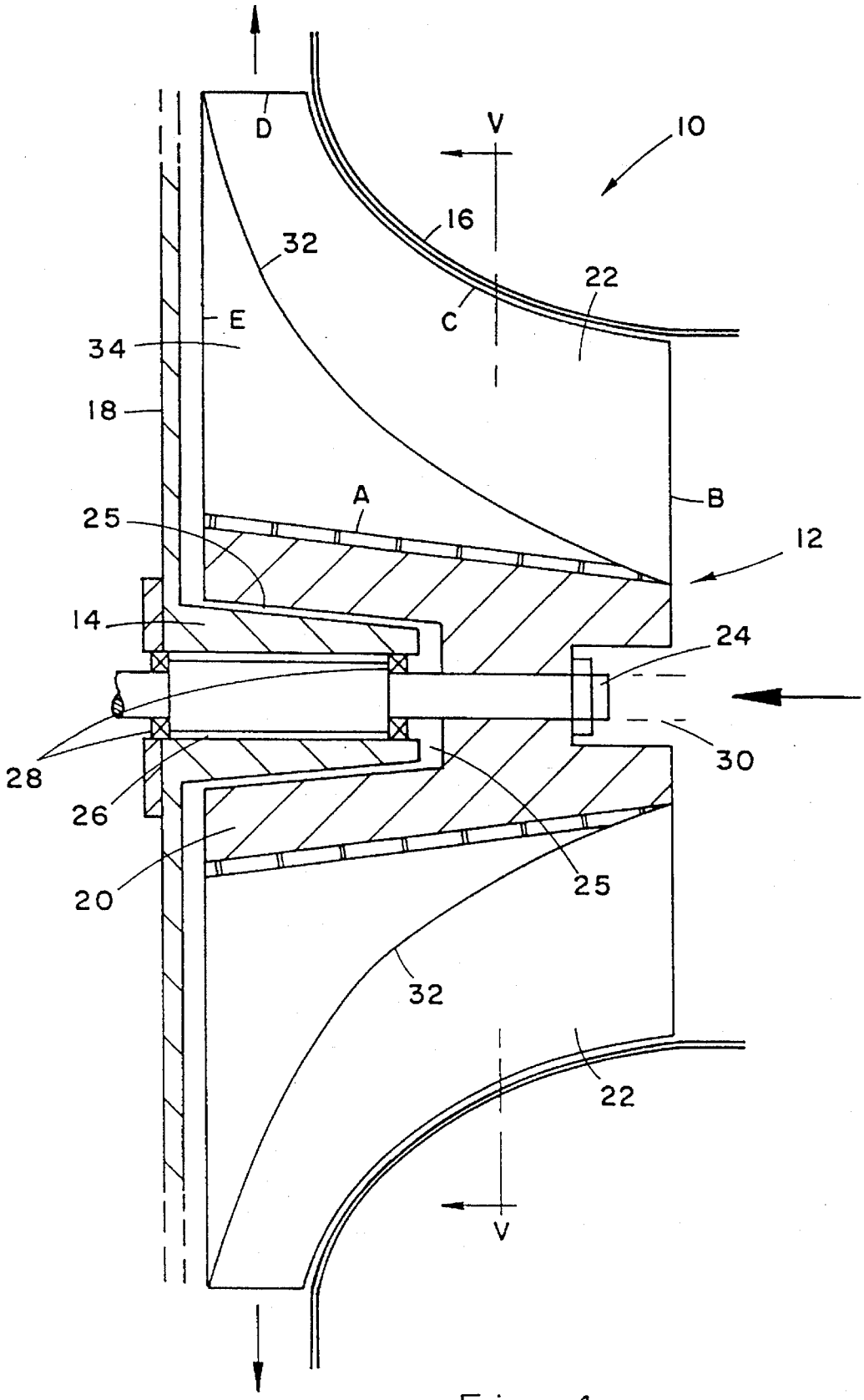
FIG. 4 is an axial cross-section of a compressor according to the invention.

FIG. 4 shows an axial cross-section of a compressor 10, which in this particular embodiment comprises a rotary member 12, rotatable around a frusto-conical stationary support 14. The compressor 10 is surrounded by a curved annular shroud 16, and is bounded at the rear by a stationary back plate 18, from which the stationary support 14 is integrally cantilevered. The rotary member 12 consists of a frusto-conical hub 20 and a plurality of curved blades 22, mounted on, and radially extending from the hub. The design of the rotary member 12 is fundamentally lightweight, being based on thin carbon fiber laminated shell type blades 22 connected to a relatively small diameter hub 20 made of aluminum alloy.

In operation the vapor to be compressed enters the shroud 16 axially, passes through a plurality of aerodynamic channels, each formed between the blades 22 and the shroud 16. The vapor is then propelled away radially in a compressed condition from the annular exit formed between the rear of the shroud 16 and the stationary back plate 18.

The following novel elements of the compressor's construction were developed by the applicant in order to minimize the weight of the rotary member.

Figure 5:
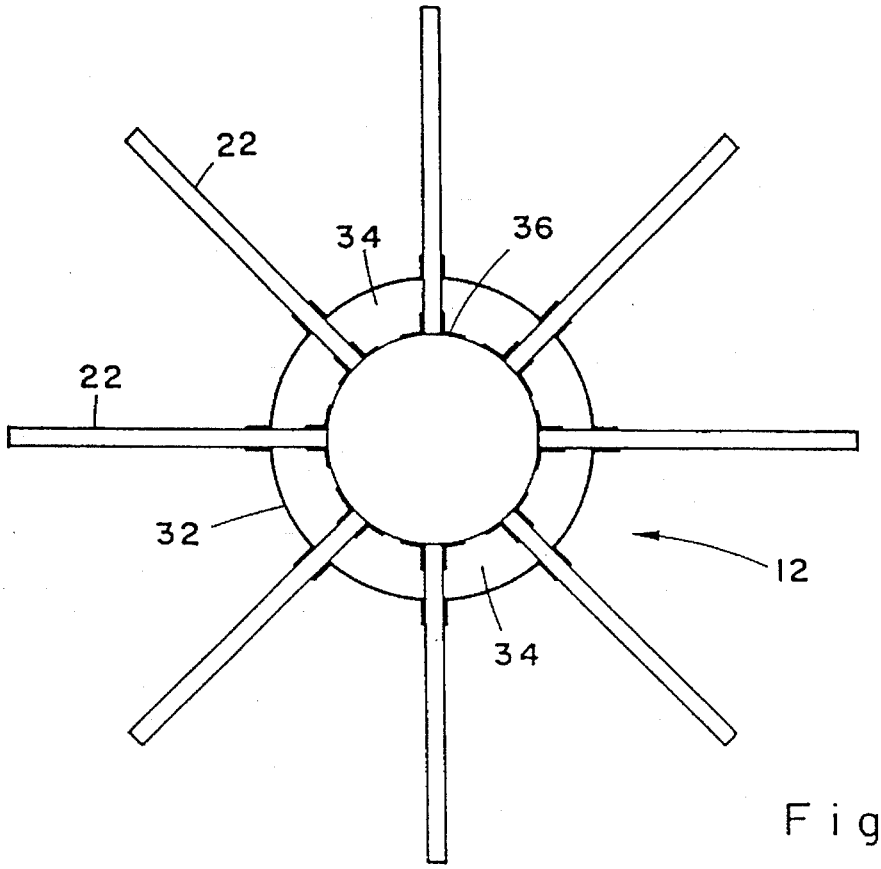
FIG. 5 is a radial cross-section of the rotary member along lines V—V in FIG. 4.

Each pair of the adjacent blades 22 are bridged by a monocoque streamlined membrane member 32 (shown in axial cross-section of the membrane 32 in FIG. 4; (a radial cross-section of the blades 22 and the membrane members 32 is shown in FIG. 5). Each membrane 32 curvingly extends from the roots A of the leading edges B of adjacent blades 22 to the tips of the rear edges E of these blades. Due to this arrangement, vapor flow channels having a desired aerodynamic shape are defined between each pair of adjacent blades 22, their associated membrane member 32, and the shroud 16. The thin bridging membrane 32, forming the vapor channel floor, also defines an empty space between it, the aluminum hub 14 and the back plate 18. This entails considerable savings in weight, with favorable implications on performance and cost. Conventional compressors are designed with integral blades and hub, where the aft diameter of the hub extends all the way to the trailing edges of the blades. In this design, according to the invention the maximum hub diameter (at its aft end) is considerably lower than the maximum diameter of the blades which improves performance, since the smaller the hub diameter, the lower the stresses produced in it at a given speed.

The rotary member 12 is rotated by a shaft 24, one end of which is splined to the hub 20, and its other end is coupled to a motor (not shown). The combination of lightweight blades and membranes result in lower stresses on the aluminum hub, which allows its center to be hollowed out. As can be seen in FIG. 4, the aft end of the hub 20 is formed with a coaxial frusto-conical recess 25 correspondingly shaped so as to receive the stationary support 14 leaving a narrow gap between them. The stationary support 14, in its turn, is provided with an axial bore 26, through which the shaft 24 passes. The shaft 24 rotates on a pair of support bearings 28, positioned inside the stationary support 14 and located at both ends of the bore 26. The hub 22 has at its forward end an additional co-axial recess 30, wherein the end of shaft 24 is accommodated. The recesses 26 and 30 further reduce the total weight of the rotary member, which causes a further reduction in mechanical stresses on the shaft and rotor support system. This feature enables a relatively small diameter shaft and rotor support to be used.

The rotary member 12 is designed and suspended by the bearings 28 in such a manner, that its center of gravity falls between the bearings 28, rather than outside the bearings' span. Since this results in a dynamically stiff system, a reduction in shaft diameter is made possible.

As can be seen in FIG. 5, the blades are bonded and screwed to metal brackets 36 which in turn are bolted to the aluminum hub 20. The membrane 32, made of a carbon fiber laminate sheet which is mechanically fastened to the sides of adjacent blades 22 defines the flow channel "floor".

Figure 6:
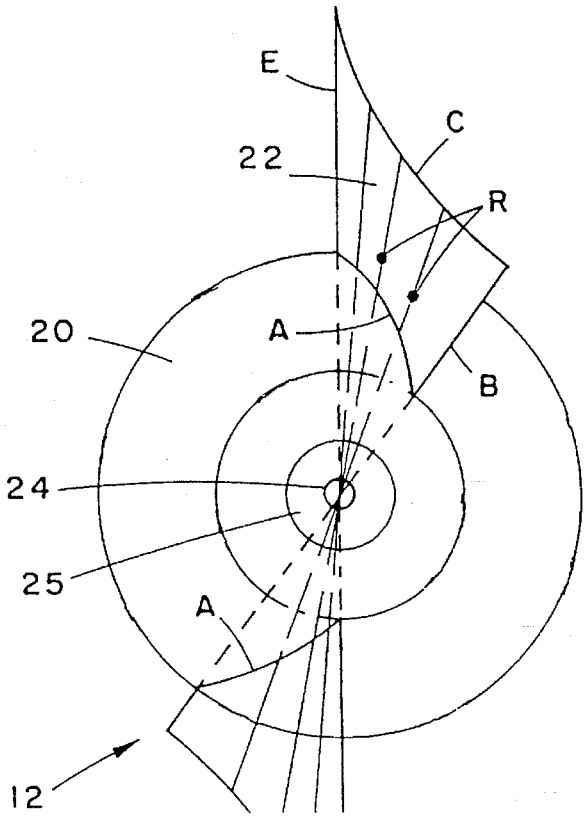
FIG. 6 is a schematic axial view of the rotary member from the forward end, showing only one pair of opposing blades.

FIG. 6 is a schematic axial view of the rotary member 12 from the forward end showing only a pair of opposing blades 22. It can be seen, that the blades 22 are mounted onto the hub 20 along longitudinal curved lines (see roots A of the blades 22 in FIG. 6). One can also see, that the blades 22 extend radially from the hub 20, i.e., a radius R extending from the axis of the hub to any point of the contour edge C (more exactly, to a point on its central line) of the blade 22 will be fully contained inside the blade. This construction leads to the following advantages:

The use of very thin lightweight flexible blades arranged in a radial manner practically eliminates bending forces on the blades, allowing the centrifugal forces to pull the blades only in the radial direction, thus minimizing the total loads applied to the rotary member i.e., this maximizes the permissible tip speed limit.

We claim:

1. A lightweight, large volume centrifugal compressor for use in mechanical vapor compression systems, especially water vapor compression systems in heat pump installations, said compressor being capable of handling a vapor flow rate of about 300–400 $m^3$/sec, providing a compression ratio of about 1:3 and sustaining mechanical stresses such as occur at tip speeds of about 500 m/sec; said compressor comprising a propeller-like rotary member consisting of a frusto-conical hub and a plurality of curved blades made of a lightweight material, each being secured to said hub along a longitudinal curved line and radially extending therefrom; each pair of adjacent blades being interconnected by a bridging membrane member of a lightweight material curvingly extending from the roots of the leading edges (as defined herein) of said adjacent blades to the tips of the rear edges of the blades (as defined herein);

said rotary member being driven by a shaft passing through the center of a stationary circular back plate bounding said rotary member at the rear;

said rotary member being encompassed within a closely fitting shroud, so that curved vapor flow channels are defined between each said pair of blades, their associated membrane member, and the shroud.

2. A compressor according to claim 1, wherein said hub is manufactured of aluminum and said blades and said membrane members are manufactured of a fiber-reinforced composite material.

3. A compressor according to claim 1, wherein said frusto-conical hub is formed at its aft end with a co-axial frusto-conical recess and is seated on a corresponding frusto-conical stationary support cantilevered from said stationary back plate; said shaft driving the frusto-conical hub passes through an axial bore in said stationary support and rotates therein by the aid of a pair of bearings located in said bore adjacent to its two ends; the center of gravity of said rotary member being between said bearing span.

4. A compressor according to claim 1, wherein each of said curved blades is shaped so that the radius extending from the axis of the hub to any point on the central line of the contour edge of the blade is fully contained inside the blade.

5. A compressor according to claim 1, wherein there are provided additional shorter blades (so-called "splitters") extending from the aft end of said hub and terminating between each pair of adjacent regular-length curved blades.

6. A mechanical water vapor compression heat pump system of the type comprising an evaporator-freezer chamber, a compressor chamber juxtaposed to said evaporator-freezer chamber and a condenser chamber juxtaposed to said compressor chamber;

means for feeding water or an aqueous solution into said evaporator-freezer chamber;

compressor means in said compressor chamber for reducing the pressure in said evaporator-freezer chamber down to the water triple point pressure to cause a portion of said water or aqueous solution to vaporize and another portion to freeze;

said compressor means being further adapted to withdraw the vapor produced within said evaporator-freezer chamber, transport it into the compressor chamber, compressing it therein and transporting the compressed vapor to said condenser chamber;

water spray means in said condenser chamber for cooling and condensing said compressed vapor by direct heat exchange therewith;

means to remove the condensate water together with the cooling water from said condensor chamber;

vacuum pump means for evacuating non-condensible gases from said condenser chamber and means for continuously removing ice-water slurry from said evaporator-freezer chamber and circulating it through heat exchanger means in a space to be cooled, located outside said heat pump system; characterized in that:

said compressor means consist of a pair of centrifugal compressors according to claim 1 operating in series and located at the opposite ends of the compressor chamber which is designed as a horizontal cylindrical vessel, each of said compressors being designed as a complete sub-assembly with its adjacent end cover of said compressor chamber; and inter-cooling water spray means are provided in said compressor vessel between said two compressors for cooling the vapor compressed by the first stage compressor before it is further compressed in the second stage compressor.

7. A heat pump system according to claim 6, wherein both the evaporator-freezer chamber and the condenser chamber are juxtaposed comparatively, closely to said compressor chamber and are connected therewith by wide, comparatively short and curved vapor inlet and outlet ducts, respectively, offering minimal resistance to the flow of vapor from the freezer-evaporator to the compressor chamber and of compressed vapor from the compressor chamber to the condenser chamber.

8. A heat pump system according to claim 6, wherein said condenser chamber is placed on top of said evaporator-freezer chamber both forming together an integral unit, the bottom of the condenser chamber serving as the top of the evaporator-freezer chamber.

* * * * *